US007568784B2

(12) United States Patent
Park et al.

(10) Patent No.: US 7,568,784 B2
(45) Date of Patent: Aug. 4, 2009

(54) INKJET PRINTHEAD AND METHOD OF MANUFACTURING THE SAME

(75) Inventors: Yong-shik Park, Seongnam-si (KR); Sung-joon Park, Suwon-si (KR); Myong-jong Kwon, Suwon-si (KR); Jin-wook Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 443 days.

(21) Appl. No.: 11/384,542

(22) Filed: Mar. 21, 2006

(65) Prior Publication Data

US 2007/0002098 A1 Jan. 4, 2007

(30) Foreign Application Priority Data

Jul. 4, 2005 (KR) ..... 10-2005-0059720

(51) Int. Cl.
*B41J 2/14* (2006.01)
*B41J 2/05* (2006.01)

(52) U.S. Cl. ..... 347/47; 347/61

(58) Field of Classification Search ..... 347/47, 347/61, 63, 65

See application file for complete search history.

(56) References Cited

U.S. PATENT DOCUMENTS 4,894,664 A * 1/1990 Tsung Pan ..... 347/63
6,761,436 B2 7/2004 Tobita et al.

FOREIGN PATENT DOCUMENTS

| | | |
|---|---|---|
| EP | 0 972 643 A3 | 1/2000 |
| JP | 2004-330605 | 11/2004 |
| KR | 1020010066825 | 7/2001 |
| KR | 1020030082261 | 10/2003 |

* cited by examiner

*Primary Examiner*—An H Do
(74) *Attorney, Agent, or Firm*—Stanzione & Kim LLP

(57) ABSTRACT

An inkjet printhead and a method of manufacturing the same. The inkjet printhead may include a substrate in which a manifold to supply ink is formed in a lower portion of the substrate and a plurality of ink feed holes connected to the manifold are formed in an upper portion of the substrate, feed hole guides that are formed on inner sidewalls of the ink feed holes to define lengths of the ink feed holes, a chamber layer stacked on the substrate, the chamber layer including a plurality of ink chambers connected to the ink feed holes, a plurality of heaters to heat ink inside the ink chambers to generate bubbles, and a nozzle layer stacked on the chamber layer, the nozzle layer including a plurality of nozzles, the ink being ejectable through the nozzles.

21 Claims, 8 Drawing Sheets

INKJET PRINTHEAD AND METHOD OF MANUFACTURING THE SAME

CROSS-REFERENCE TO RELATED APPLICATIONS

This application claims priority under 35 U.S.C. §119(a) from Korean Patent Application No. 2005-59720, filed on Jul. 4, 2005, in the Korean Intellectual Property Office, the disclosure of which is incorporated herein in its entirety by reference.

BACKGROUND OF THE INVENTION

1. Field of the Invention

The present general inventive concept relates to an inkjet print head and a method of manufacturing the same, and more particularly, to an inkjet printhead and a method of manufacturing the same that can improve reliability and print quality of an image.

2. Description of the Related Art

Generally, inkjet printers print an image of a predetermined color by discharging ink from a printhead at a desired location on a print medium. The inkjet printers are classified into shuttle-type inkjet printers and line printing type inkjet printers. In the shuttle-type inkjet printers, a printhead performs printing operations by moving up and down perpendicular to a transport direction of a print medium. The line printing type inkjet printers, which are currently being developed to perform high speed printing, include one or plural printheads having a width corresponding to a width of the print medium. The printhead, which is fixed, performs printing as the print medium moves. An array printhead, in which a plurality of printheads are arranged in a predetermined pattern, is commonly-used in the line printing type inkjet printers.

Inkjet printheads are largely categorized into two types depending on an ink droplet ejection mechanism used by the printheads: a thermally-driven inkjet printhead, in which a heat source is employed to form and expand bubbles in ink causing ink droplets to be ejected, and a piezoelectrically driven inkjet printhead, in which a piezoelectric material deforms to exert pressure on ink causing ink droplets to be ejected.

The ink ejection mechanism in the thermally driven inkjet printhead is as follows. When a pulse current flows through a heater formed of a resistance heating material, heat is generated in the heater, and ink adjacent to the heater is instantaneously heated to about 300° C. As such, the ink boils, and bubbles generated in the ink expand and apply pressure to an inside of an ink chamber filled with ink. As a result, the ink in the vicinity of nozzles is ejected through the nozzles in droplets.

Recently, to increase the printing speed of inkjet printers, sizes of printheads and numbers of nozzles have been increased. In this case, reliability and print quality can be reduced if a difference exists between an ejection ability of the nozzles. Also, a difference between a performance of printheads can occur in array printheads that are being developed to enable high speed printing. Therefore, in order to improve reliability and print quality, print abilities and performances of the nozzles of the printheads or each of the printheads of the array printheads need to be constant.

FIG. 1 is a perspective view illustrating a portion of a conventional thermally-driven inkjet printhead.

Referring to FIG. 1, the inkjet printhead is composed of a substrate 10, a chamber layer 20 stacked on top of the substrate to form ink chambers 25, and a nozzle layer 30 stacked on top of the chamber layer 20. Ink to be ejected fills the ink chambers 25, and a heater 27 is formed on a bottom surface of each of the ink chambers 25 to heat the ink inside the ink chambers 25 to generate bubbles. Nozzles 35 through which the ink is ejected are formed in the nozzle layer 30 corresponding to each of the ink chambers 25. A manifold 12 is formed on a lower portion of the substrate for commonly-supplying the ink, and ink feed holes 14 for individually supplying the ink from the manifold 12 into the ink chambers 25 are formed in an upper portion of the substrate 10.

In the conventional inkjet printhead constructed as above, less cross-talk can occur between adjacent nozzles 35 since the ink feed holes 14 individually-supply the ink into each of the ink chambers 25. In addition, a size of the printheads can be reduced since an arrangement of electrical wires is simplified. However, it is difficult to make lengths of the ink feed holes 14 the same. As a result, the lengths of the ink feed holes 14 can be different, which consequently causes a difference in an ejection ability of the ink between the nozzles 35, thereby lowering a print quality of images.

FIGS. 2A and 2B are views of simulation results illustrating ink ejection when the lengths of the ink feed holes 14 in FIG. 1 are respectively 30 and 20 μm. When the length of the ink feed hole 14 is 30 μm, a speed at which the ink is ejected is 8.97 m/s, a volume of the ink that is ejected is 4.31 pl, and a driving frequency is 28 kHz. When the length of the ink feed hole 14 is 20 μm, the speed at which the ink is ejected is 8.76 m/s, the volume of the ink that is ejected is 5.75 pl, and the driving frequency is 20 kHz. This demonstrates that the ejection abilities of the nozzles 35 are different if there is a difference in the lengths of the ink feed holes 14. As such, if the lengths of the ink feed holes 14 are different, it is difficult to manufacture inkjet printheads in which the ejection abilities of the nozzles 35 are the same. In addition, in array printheads configured to have a plurality of printheads, the amount of the ink ejected and the ejection speed of the ink differ for each printhead due to differences in the ejection abilities of the nozzles 35. Consequently, the differences in print quality among the printheads lower print quality.

SUMMARY OF THE INVENTION

The present general inventive concept provides an inkjet printhead and a method of manufacturing the same, which can improve reliability and print quality by making the lengths of ink feed holes the same.

Additional aspects and advantages of the present general inventive concept will be set forth in part in the description which follows and, in part, will be obvious from the description, or may be learned by practice of the general inventive concept.

The foregoing and/or other aspects and utilities of the present general inventive concept may be achieved by providing an inkjet printhead, including a substrate including a manifold to supply ink formed in a lower portion of the substrate and a plurality of ink feed holes connected to the manifold formed in an upper portion of the substrate, feed hole guides formed on inner sidewalls of the plurality of ink feed holes to define lengths of the ink feed holes, a chamber layer stacked on the substrate, the chamber layer including a plurality of ink chambers connected to the ink feed holes, a plurality of heaters to heat ink inside the plurality of ink chambers to generate bubbles, and a nozzle layer stacked on the chamber layer, the nozzle layer including a plurality of nozzles, the ink being ejectable through the nozzles.

The ink feed holes may be formed to correspond to the ink chambers.

A ceiling of the manifold may be level with or higher than lowest ends of the feed hole guides. The feed hole guides may be made of a material having etch selectivity to the substrate.

The foregoing and/or other aspects and utilities of the present general inventive concept may be achieved by providing a method of forming an inkjet printhead, the method including forming a plurality of heaters on a substrate, forming a plurality of ink feed holes in an upper portion of the substrate, lengths of the ink feed holes being defined by feed hole guides, stacking a chamber layer on the substrate, the chamber layer including a plurality of ink chambers connected to the ink feed holes, forming a nozzle layer on the chamber layer, the nozzle layer including a plurality of nozzles connected to the ink chambers, and forming a manifold connected to the ink feed holes at a lower portion of the substrate.

The forming of the ink feed holes may include forming trenches to encompass regions where the ink feed holes are to be formed by etching an upper portion of the substrate to a predetermined depth, forming the feed hole guides by filling the trenches with a predetermined material, and forming the ink feed holes by removing the upper portion of the substrate located between the feed hole guides.

The forming of the ink feed holes may include forming the ink feed holes by etching an upper portion of the substrate to a predetermined depth, forming a predetermined material layer on the substrate so that the material layer covers the ink feed holes, and forming the feed hole guides on inner sidewalls of the ink feed holes by patterning the material layer.

The manifold may be formed by etching a lower portion of the substrate so that lowest ends of the feed hole guides are exposed. A ceiling of the manifold may be level with or higher than lowest ends of the feed hole guides.

The foregoing and/or other aspects and utilities of the present general inventive concept may also be achieved by providing a method of forming an inkjet printhead, the method including forming a plurality of heaters on a substrate, forming a plurality of ink feed holes in an upper portion of the substrate, lengths of the ink feed holes being defined by feed hole guides, forming a manifold connected to the ink feed holes at a lower portion of the substrate, stacking a chamber layer on the substrate, the chamber layer including a plurality of ink chambers connected to the ink feed holes, and stacking a nozzle layer on the chamber layer, the nozzle layer including a plurality of nozzles connected to the ink chambers.

The lengths of the plurality of ink feed holes from a floor of the plurality of ink chambers to a lowest end of corresponding ones of the feed hole guides may be identical. The lengths of the feed hole guides may be greater than or equal to a distance from a floor of the plurality of ink chambers to a ceiling of the manifold.

The foregoing and/or other aspects and utilities of the present general inventive concept may also be achieved by providing an inkjet print head usable with an-image forming apparatus including at least one inkjet printhead, the inkjet printhead including a substrate comprising a plurality of heaters located at the upper portion of the substrate and a manifold located at a lower portion of the substrate, a chamber layer stacked on top of the substrate to form a plurality of ink chambers, a nozzle layer stacked on top of the chamber layer, the nozzle layer comprising a plurality of nozzles corresponding to the plurality of ink chambers, and a plurality of ink feed holes located at the upper portion of the substrate to individually-supply ink from the manifold to corresponding ones of the plurality of ink chambers, the plurality of ink feed holes comprising corresponding feed hole guides located at inner side walls of the plurality of ink feed holes, lengths of the plurality of ink feed holes being defined by the feed hole guides.

The foregoing and/or other aspects and utilities of the present general inventive concept may also be achieved by providing an inkjet print head, including a substrate having a first wall to define a manifold, and a second wall to provide an ink feed hole, a feed hole guide formed on the second wall to define the ink feed hole to communicate with the manifold, a chamber layer formed on a third wall of the substrate, and a nozzle layer formed on the chamber layer to form an ink chamber with the chamber layer and the third wall. The feed hole guide may have a length longer than that of the ink feed hole in an ink feed direction from the manifold to the ink chamber. The feed hole guide may protrude from an end of the second wall toward and inside of the manifold. The feed hole guide may protrude from the first wall. The feed hole guide may include a first portion to form the ink chamber with the third wall, the chamber layer, and the nozzle layer, a second portion to form the ink feed hole, and a third portion extended from the second portion and disposed inside the manifold. The substrate may include a fourth wall to define a second manifold, and a fifth wall to provide a second ink feed hole, a second feed hole guide may be formed on the fifth wall to define the second ink feed hole to communicate with the second manifold, a second chamber layer may be formed on a sixth wall of the substrate, and a second nozzle layer may be formed on the second chamber to form a second ink chamber with the second chamber layer and the sixth wall. The feed hole guide and the second feed hole guide may have the same length in an axis of the ink feed hole. The second feed hole guide may protrude from the first and second walls of the substrate toward the manifold. The nozzle layer and the second nozzle layer may be formed in a single monolithic body. The manifold and the second manifold may be a common manifold.

The foregoing and/or other aspects and utilities of the present general inventive concept may also be achieved by providing a method of manufacturing an inkjet printhead, including forming heaters on upper portions of a substrate, etching a plurality of trenches in the upper portions of the substrate to a predetermined depth, filling the trenches with a material having etch sensitivity to the substrate to form feed hole guides, etching an area of the upper portion of the substrate located between the feed hole guides to form an ink feed hole in the substrate between the filled trenches, forming a chamber layer on top of the substrate, the chamber layer comprising an ink chamber connected to the ink feed hole, forming a nozzle layer on top of the chamber layer, the nozzle layer comprising a nozzle connected to the ink chamber, and etching a lower portion of the substrate to form a manifold. The forming the chamber layer may include stacking a predetermined chamber material layer on top of the substrate, and patterning the stacked chamber material layer in a predetermined shape to form the ink chamber. The forming the nozzle layer may include stacking a predetermined nozzle material layer on top of the substrate, and patterning the stacked nozzle material layer in a predetermined shape to form the nozzle.

The foregoing and/or other aspects and utilities of the present general inventive concept may also be achieved by providing a method of manufacturing an inkjet print head, including forming heaters on upper portions of a substrate, etching an area of the upper portion of the substrate to a predetermined depth to form an ink feed hole, coating a material layer onto the substrate to cover the ink feed hole, the material layer comprising a material having etch sensitivity to the substrate, patterning the material layer such that the material layer is located only at inner side walls of the ink feed hole to form feed hole guides, forming a chamber layer on top of the substrate, the chamber layer comprising an ink chamber connected to the ink feed hole, forming a nozzle layer on top of the chamber layer, the nozzle layer comprising a nozzle connected to the ink chamber, and etching a lower portion of the substrate to form a manifold.

The foregoing and/or other aspects and utilities of the present general inventive concept may also be achieved by providing a method of printing using an inkjet printer, the printer including a substrate, a plurality of heaters, a plurality of ink chambers, a plurality of ink feed holes corresponding to the plurality of ink chambers and defined by feed hole guides having a same length and located on inner sidewalls of the plurality of ink feed holes, and a plurality of nozzles corresponding to the plurality of ink feed holes, the method including selectively heating ink in the nozzles in an image-wise pattern, and ejecting droplets of the ink in the image-wise pattern onto a print medium.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
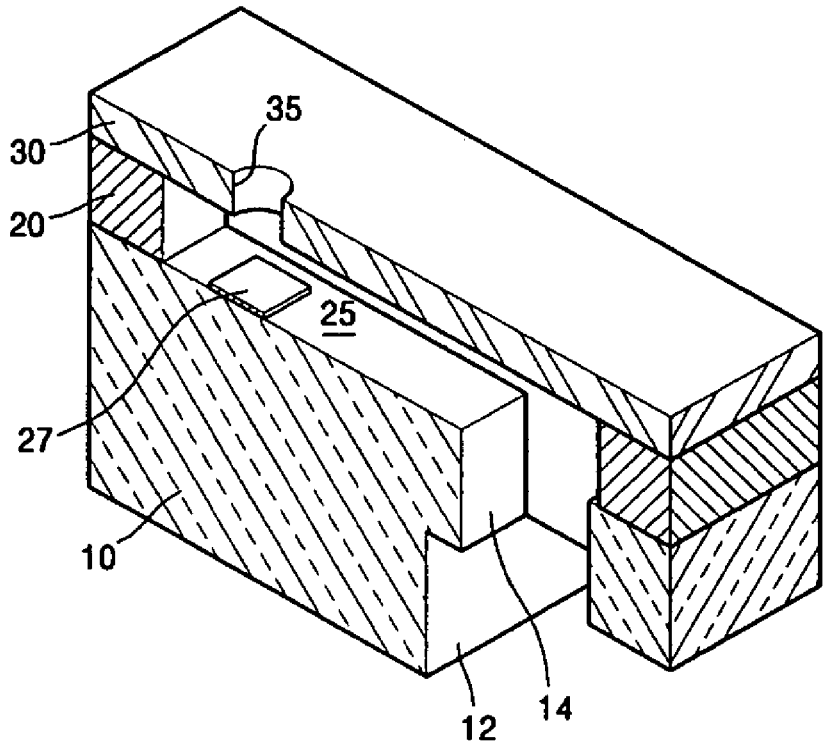
FIG. 1 (PRIOR ART)
FIG. 1 is a perspective view illustrating a portion of a conventional thermally-driven inkjet printhead.
Figure 2A:
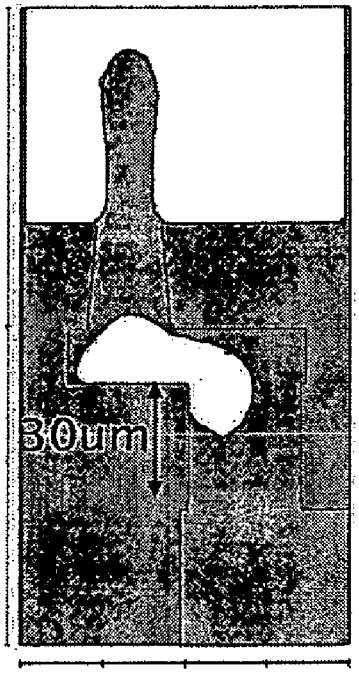
FIGS. 2A and 2B are views of simulation results illustrating ink ejection when lengths of ink feed holes in FIG. 1 are respectively 30 and 20 μm.
Figure 2B:
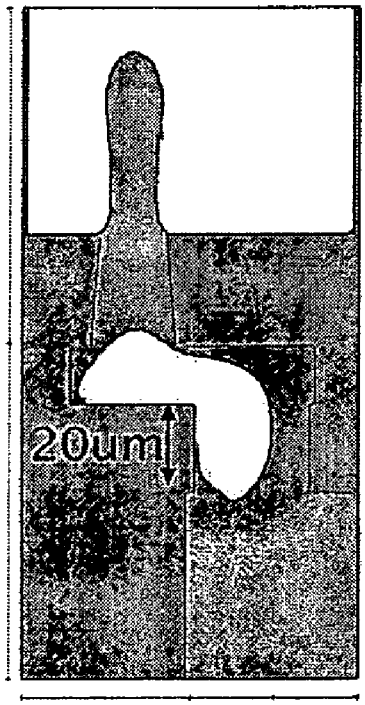

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 3:
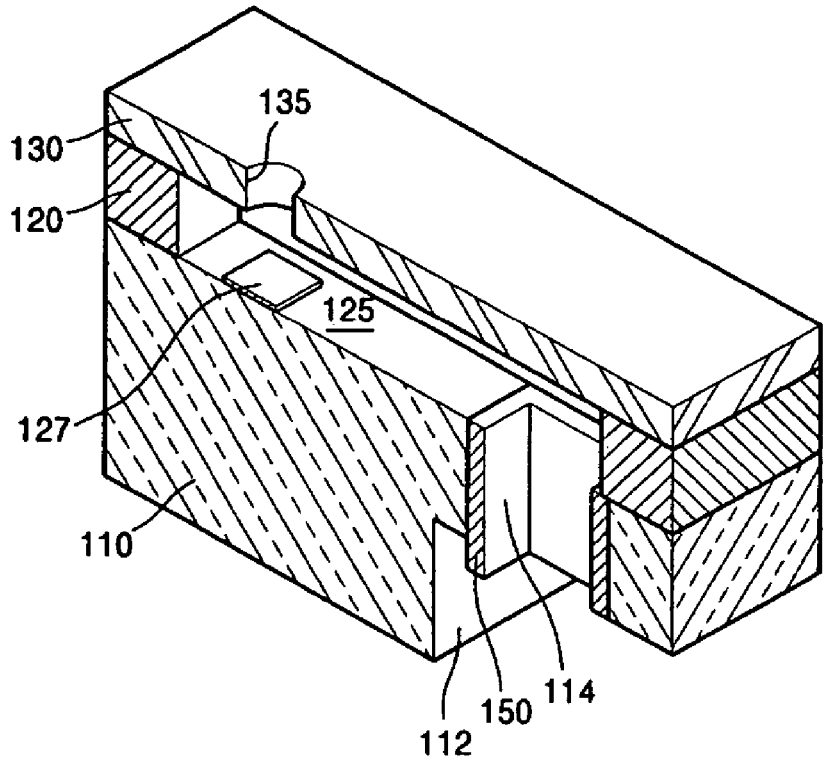
FIG. 3 is a perspective view illustrating a portion of an inkjet printhead according to an embodiment of the present general inventive concept.
Figure 4:
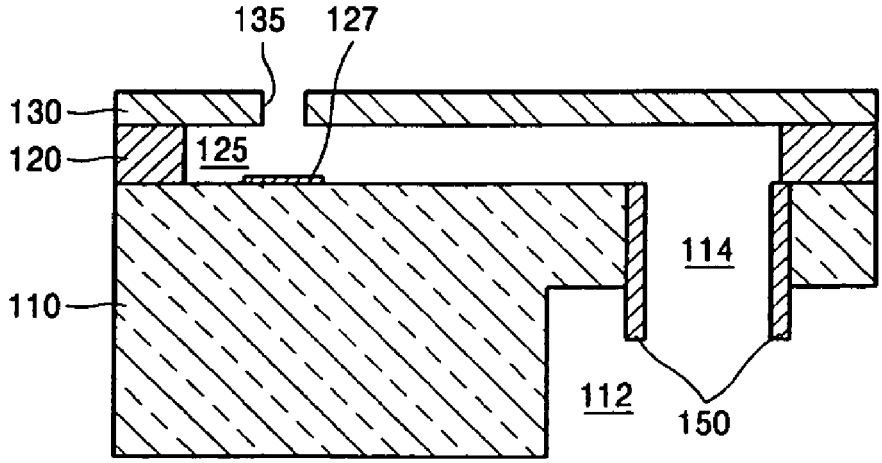
FIG. 4 is a cross-sectional view of the inkjet printhead illustrated in FIG. 3.

FIG. 3 is a perspective view illustrating a portion of an inkjet printhead according to an embodiment of the present general inventive concept, and FIG. 4 is a cross-sectional view of the inkjet printhead illustrated in FIG. 3. For convenience, only a unit structure of the inkjet printhead is illustrated in FIGS. 3 and 4.

Referring to FIGS. 3 and 4, the inkjet printhead includes a substrate 110, a chamber layer 120 stacked on top of the substrate 110 to form a plurality of ink chambers 125, and a nozzle layer 130 stacked on top of the chamber layer 120. Ink to be ejected fills the ink chambers 125, and a heater 127 is formed on a surface of the substrate 110 corresponding to a bottom surface of each of the ink chambers 125 to heat the ink inside the ink chambers 125 and to generate bubbles. Nozzles 135 through which the ink is ejected are formed in the nozzle layer 130 to correspond to each of the ink chambers 125.

A plurality of ink feed holes 114 for individually supplying the ink from a manifold 112, which is described below, into each of the ink chambers 125 are formed in an upper portion of the substrate 110. The ink feed holes 114 are formed to respectively correspond to each of the ink chambers 125. A feed hole guide 150 is formed on an inner wall of each of the ink feed holes 114. The feed hole guides 150 make lengths of the ink feed holes 114 identical to each other. Thus, the ink feed holes 114 have identical lengths using the feed hole guides 150. The feed hole guides 150 may be made of a material having etch selectivity to the substrate 110. In other words, the material of the feed hole guides 150 is different from a material of the substrate 110, such that when the substrate 110 is etched, the feed hole guides 150 are not etched, or are etched at a significantly-lower rate. For example, if the substrate 110 is made of silicon, the feed hole guides 150 may be made of silicon oxide or silicon nitride.

The manifold 112 connected to the ink feed holes 114 is formed at a lower portion of the substrate 110. The manifold 112 supplies ink to all of the ink feed holes 114. The ceiling of the manifold 114 may be located at the same height as the lowest end of the feed hole guide 150 or higher than the lowest end of the feed hole guide 150.

According to the inkjet printhead illustrated in FIGS. 3 and 4, the feed hole guides 150 are formed on inner walls of the ink feed holes 114 to make the lengths of the ink feed holes 114 to be equal. That is, the feed hole guides 150 formed on the inner walls of the ink feed holes 11 4 enable the ink feed holes 114 to have identical lengths.

Figure 5A:
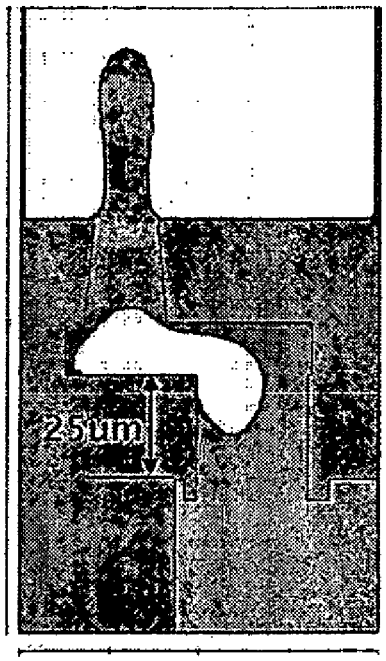
FIGS. 5A and 5B are views of simulation results illustrating ink ejection when a distance between a floor of an ink chamber and a ceiling of a manifold are respectively 25 and 10 μm in an inkjet printhead in which ink feed holes have identical lengths according to an embodiment of the present general inventive concept.
Figure 5B:
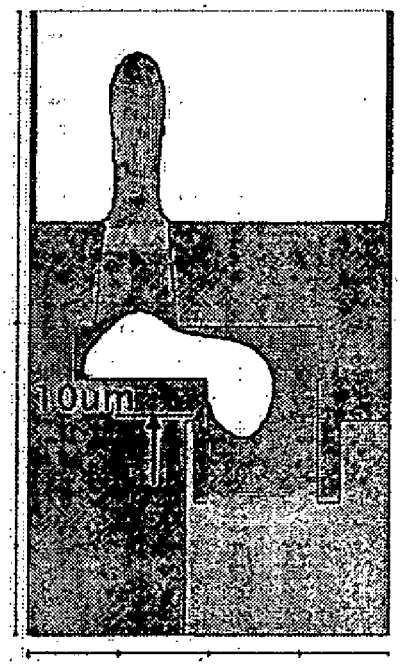

FIGS. 5A and 5B are views of simulation results illustrating ink ejection when a distance between a floor of an ink chamber and a ceiling of a manifold are respectively 25 and 10 μm in an inkjet printhead in which ink feed holes have identical lengths according to an embodiment of the present general inventive concept. The results of the experiments demonstrated that a speed at which the ink is ejected is 8.72 m/s, a volume of ink that is ejected is 5.00 pl, and a driving frequency is 28 kHz when the distance between the floor of the ink chamber and the ceiling of the manifold is 25 μm. When the distance between the floor of the ink chamber and the ceiling of the manifold is 10 μm, the speed at which ink is ejected is 8.77 m/s, the volume of ink that is ejected is 5.00 pl, and the driving frequency is 27 kHz. Thus, for the inkjet printhead according to an embodiment of the present general inventive concept, in which the ink feed holes have the same length, there is little, if any, difference in the ejection abilities of the nozzles, even if the distance between the floor of the ink chamber and the ceiling of the manifold changes.

The ink feed holes have the same lengths by using the feed hole guides in the inkjet printhead according to an embodiment of the present general inventive concept. Therefore, identical ejection abilities of the nozzles can be maintained. As a result, reliability and print quality of the printhead can be improved. In addition, in an array printhead having a plurality of printheads according to an embodiment of the present general inventive concept, print quality among the printheads can be uniform.

A method of manufacturing an inkjet printhead according to an embodiment of the present general inventive concept will be described with reference to FIGS. 6 through 13 below. FIGS. 6 through 13 are views illustrating a method of manufacturing an inkjet printhead according to an embodiment of the present general inventive concept.

Figure 6:
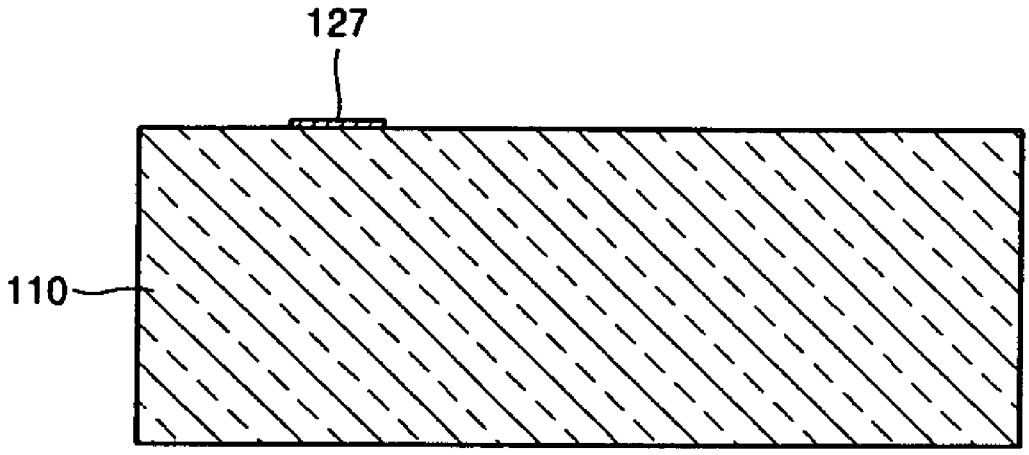
FIGS. 6 through 13 are views illustrating a method of manufacturing an inkjet printhead according to an embodiment of the present general inventive concept.

First, referring to FIG. 6, heaters 127 are formed on a surface of a substrate 110 having a predetermined thickness. The substrate 110 may be, for example, a silicon substrate. The heaters 127 may be formed by depositing a heat-resistive material on top of the substrate 110, and then patterning the heat-resistive material into a predetermined shape.

Figure 7:
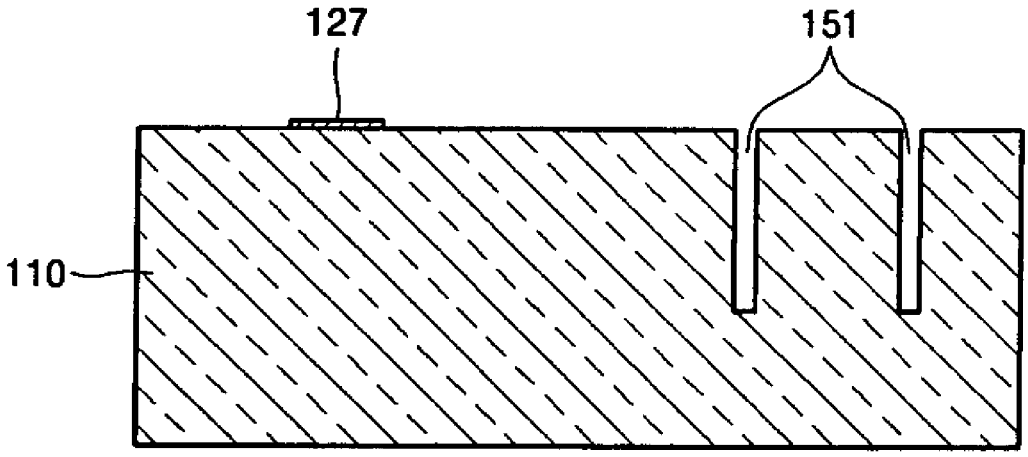

Referring to FIG. 7, upper portions of the substrate 110 at which the heaters 127 are formed are etched to a predetermined depth to form trenches 151 that encompass regions in which ink feed holes 114 (see FIG. 9) are to be formed. The trenches 151 are formed to corresponding to the heaters 127.

Figure 8:
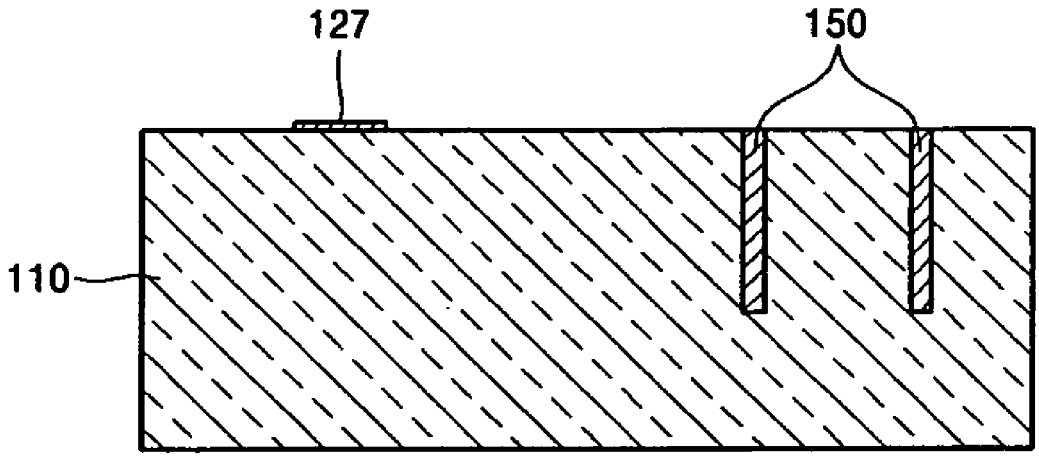

Referring to FIG. 8, feed hole guides 150 are formed by filling the trenches 151 with a predetermined material. The feed hole guides 150 may be made of a material having etch selectivity to the substrate 110. For example, if the substrate 110 is made of silicon, the feed hole guides 150 may be made of, for example, silicon oxide or silicon nitride.

Figure 9:
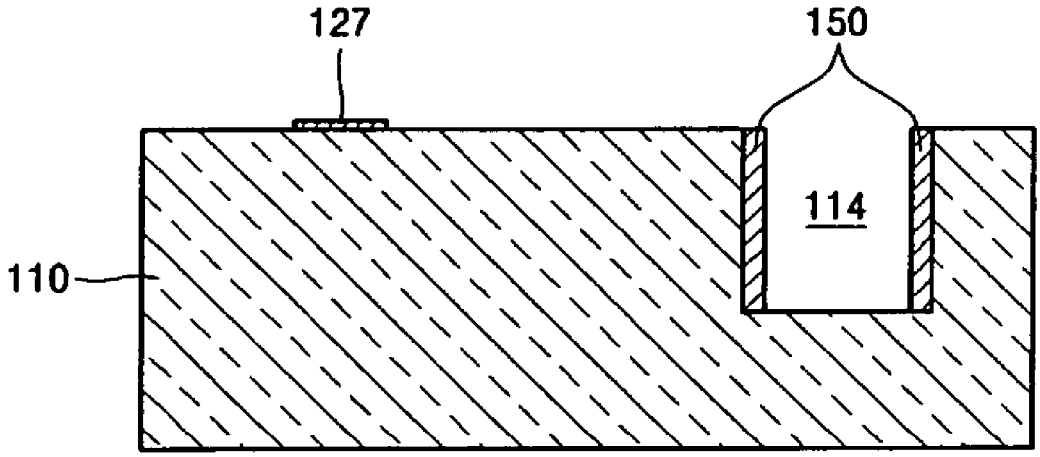

Referring to FIG. 9, upper portions of the substrate 110 encompassed by the feed hole guides 150 are etched and removed so that ink feed holes 114 in which the feed hole guides 150 are provided on inner sidewalls are formed at the upper portions of the substrate 110. The lengths of the ink feed holes 114 are defined by the feed hole guides 150.

Figure 12:
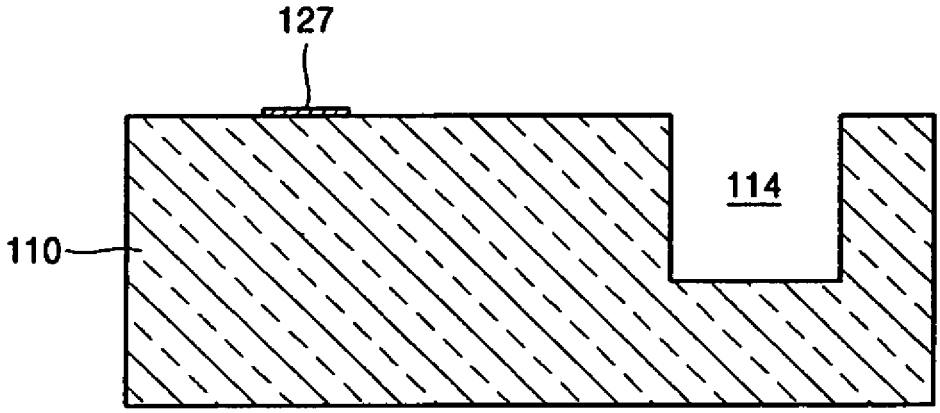
Figure 13:
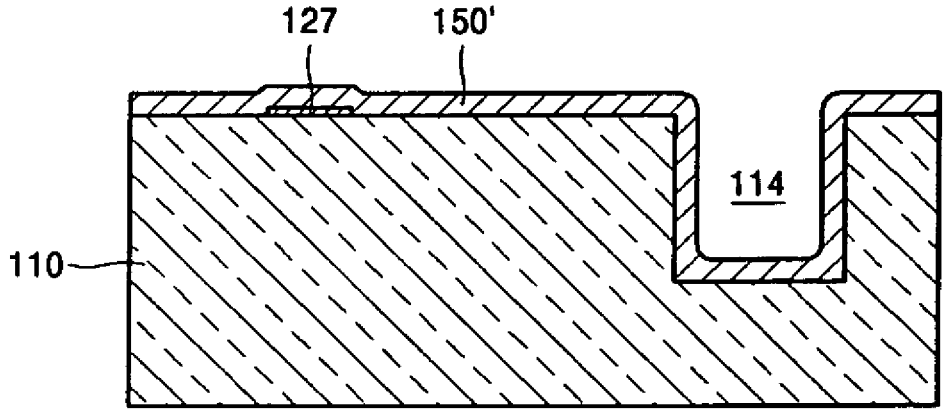

The ink feed holes 114 may also be formed by processes illustrated in FIGS. 12 and 13. First, referring to FIG. 12, the upper portion of the substrate 110 on which the heaters 127 are formed may be etched to a predetermined depth to form ink feed holes 114. Next, referring to FIG. 13, a predetermined material layer 150' may be coated on the substrate 110 to cover the ink feed holes 114. The material layer 150' may be made of a material having etch selectivity to the substrate 110. The material layer 150' may be patterned in a way so that the material layer 150' remains only on the inner sidewalls of the ink feed holes 114. Consequently, the ink feed holes 114 are formed, having the feed hole guides 150 formed on the inner sidewalls thereof, as illustrated in FIG. 9.

Figure 10:
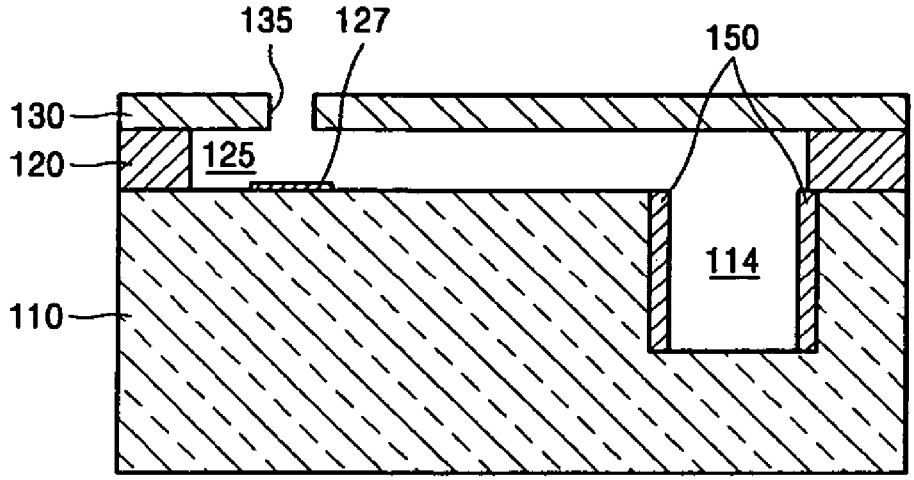

Next, referring to FIG. 10, a chamber layer 120, in which a plurality of ink chambers 125 connected to the ink feed holes 114 are formed, is formed on top of the substrate 110. The ink chambers 125 are formed to correspond to the ink feed holes 114 so that the ink feed holes 114 can individually supply ink to each of the ink chambers 125 from a manifold 112 (see FIG. 11), which is described later. The chamber layer 120 may be formed by stacking a predetermined material layer on top of the substrate 110 and patterning the material layer in a predetermined shape to form the ink chambers 125. Thereafter, a nozzle layer 130 is formed on top of the chamber layer 120. A plurality of nozzles 135 connected to the ink chambers 125 are formed in the nozzle layer 130. The nozzle layer 130 may be formed by stacking a predetermined material layer on top of the chamber layer 120 and then patterning the material layer in a predetermined shape to form the nozzles 135.

Figure 11:
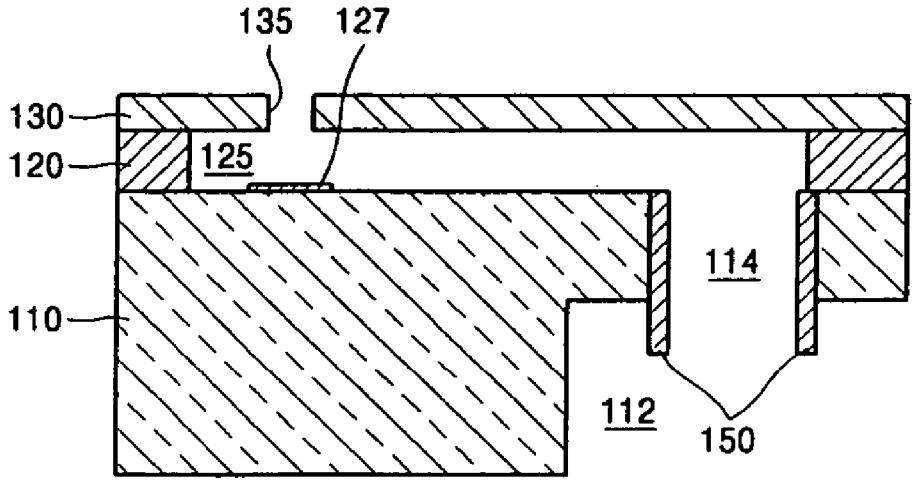

Referring to FIG. 11, when a lower portion of the substrate 110 is etched to form the manifold 112 connected to the ink feed holes 114, the inkjet printhead according to the present embodiment is completed. In the process of etching the lower portion of the substrate 110, lower ends of the feed hole guides 150 are exposed. The feed hole guides 150 made of a material having etch selectivity to the substrate 110 is not etched, and only the substrate 110 continues to be etched to form the manifold 112. Therefore, a ceiling of the manifold 112 is higher than the lower ends of the feed hole guides 150. Alternatively, the ceiling of the manifold 112 may be of the same height as the lower ends of the feed hole guides 150.

In the method described above, the chamber layer 120 and the nozzle layer 130 are formed before the manifold 112 is formed at the lower portion of the substrate 110. However, in embodiments, the manifold 112 may be formed at the lower portion of the substrate 110 before the chamber layer 120 and the nozzle layer 130 are formed.

The present general inventive concept described above has at least the following advantages, in addition to other advantages.

Ink feed holes having identical lengths can be formed by forming feed hole guides that define lengths of the ink feed holes on inner sidewalls of the ink feed holes. Accordingly, printing abilities of each of a plurality of nozzles in printheads and each of the printheads in an array printhead can be maintained to be uniform, thereby improving reliability and print quality of an image. In addition, yield rate of the printhead can be increased, thereby reducing manufacturing costs.

In an inkjet printhead according to an embodiment of the present general inventive concept, ink feed holes are structured to individually supply ink to each of a plurality of ink chambers. As a result, cross talk between adjacent nozzles does not occur, and an arrangement of electrical wires is simplified, thereby reducing a size of the printhead.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet printhead, comprising:

a substrate comprising:

a manifold to supply ink formed in a lower portion of the substrate, and a plurality of ink feed holes connected to the manifold formed in an upper portion of the substrate;

feed hole guides formed on inner sidewalls of the plurality of ink feed holes to define lengths of the ink feed holes;

a chamber layer stacked on the substrate, the chamber layer comprising a plurality of ink chambers connected to the ink feed holes;

a plurality of heaters to heat ink inside the plurality of ink chambers to generate bubbles; and a nozzle layer stacked on the chamber layer, the nozzle layer comprising a plurality of nozzles, the ink being ejectable through the nozzles.

2. The inkjet printhead of claim 1, wherein the ink feed holes are formed to correspond to the ink chambers.

3. The inkjet printhead of claim 1, wherein a ceiling of the manifold is level with or higher than lowest ends of the feed hole guides.

4. The inkjet printhead of claim 1, wherein the feed hole guides are made of a material having etch selectivity to the substrate.

5. The inkjet printhead of claim 4, wherein the substrate is made of silicon, and the feed hole guides are made of silicon oxide or silicon nitride.

6. The inkjet printhead of claim 1, wherein the heaters are disposed on a surface of the substrate forming at least a portion of a floor of each of the ink chambers.

7. The inkjet print head of claim 1 wherein the lengths of the plurality of ink feed holes from a floor of the plurality of ink chambers to a lowest end of corresponding ones of the feed hole guides are identical.

8. The inkjet print head of claim 1, wherein the lengths of the feed hole guides are greater than or equal to a distance from a floor of the plurality of ink chambers to a ceiling of the manifold.

9. A method of forming an inkjet printhead, the method comprising:

forming a plurality of heaters on a substrate;

forming a plurality of ink feed holes in an upper portion of the substrate, lengths of the ink feed holes being defined by feed hole guides;

wherein the forming of the ink feed holes comprises:

forming trenches to encompass regions where the ink feed holes are to be formed by etching an upper portion of the substrate to a predetermined depth;

forming the feed hole guides by filling the trenches with a predetermined material; and forming the ink feed holes by removing the upper portion of the substrate located between the feed hole guides;

stacking a chamber layer on the substrate, the chamber layer comprising a plurality of ink chambers connected to the ink feed holes;

forming a nozzle layer on the chamber layer, the nozzle layer comprising a plurality of nozzles connected to the ink chambers; and forming a manifold connected to the ink feed holes at a lower portion of the substrate.

10. A method of forming an inkjet printhead, the method comprising:

forming a plurality of heaters on a substrate;

forming a plurality of ink feed holes in an upper portion of the substrate, lengths of the ink feed holes being defined by feed hole guides;

wherein the forming of the ink feed holes comprises:

forming the ink feed holes by etching an upper portion of the substrate to a predetermined depth;

forming a predetermined material layer on the substrate so that the material layer covers the ink feed holes; and forming the feed hole guides on inner sidewalls of the ink feed holes by patterning the material layer;

stacking a chamber layer on the substrate, the chamber layer comprising a plurality of ink chambers connected to the ink feed holes;

forming a nozzle layer on the chamber layer, the nozzle layer comprising a plurality of nozzles connected to the ink chambers; and forming a manifold connected to the ink feed holes at a lower portion of the substrate.

11. An inkjet print head useable with an image forming apparatus comprising:

a substrate comprising a plurality of heaters located at the upper portion of the substrate and a manifold located at a lower portion of the substrate;

a chamber layer stacked on top of the substrate to form a plurality of ink chambers;

a nozzle layer stacked on top of the chamber layer, the nozzle layer comprising a plurality of nozzles corresponding to the plurality of ink chambers; and a plurality of ink feed holes located at the upper portion of the substrate to individually supply ink from the manifold to corresponding ones of the plurality of ink chambers, the plurality of ink feed holes comprising corresponding feed hole guides located at inner side walls of the plurality of ink feed holes, lengths of the plurality of ink feed holes being defined by the feed hole guides.

12. An inkjet print head, comprising:

a substrate having a first wall to define a manifold, and a second wall to provide an ink feed hole;

a feed hole guide formed on the second wall to define the ink feed hole to communicate with the manifold;

a chamber layer formed on a third wall of the substrate; and a nozzle layer formed on the chamber layer to form an ink chamber with the chamber layer and the third wall.

13. The inkjet print head of claim 12, wherein the feed hole guide has a length longer than that of the ink feed hole in an ink feed direction from the manifold to the ink chamber.

14. The inkjet print head of claim 12, wherein the feed hole guide protrudes from an end of the second wall toward and inside of the manifold.

15. The inkjet print head of claim 12, wherein the feed hole guide protrudes from the first wall.

16. The inkjet print head of claim 12, wherein the feed hole guide comprises:

a first portion to form the ink chamber with the third wall, the chamber layer, and the nozzle layer;

a second portion to form the ink feed hole; and a third portion extended from the second portion and disposed inside the manifold.

17. The inkjet print head of claim 12, wherein:

the substrate comprises a fourth wall to define a second manifold, and a fifth wall to provide a second ink feed hole;

a second feed hole guide is formed on the fifth wall to define the second ink feed hole to communicate with the second manifold;

a second chamber layer is formed on a sixth wall of the substrate; and a second nozzle layer formed on the second chamber to form a second ink chamber with the second chamber layer and the sixth wall.

18. The inkjet print head of claim 17, wherein the feed hole guide and the second feed hole guide have the same length in an axis of the ink feed hole.

19. The inkjet print head of claim 17, wherein the second feed hole guide protrudes from the first and second walls of the substrate toward the manifold.

20. The inkjet print head of claim 17, wherein the nozzle layer and the second nozzle layer are formed in a single monolithic body.

21. The inkjet print head of claim 17, wherein the manifold and the second manifold are a common manifold.

* * * * *